US005518872A

United States Patent [19]

King et al.

[11] Patent Number: 5,518,872

[45] Date of Patent: May 21, 1996

[54] EMULSION AND PHOTOGRAPHIC ELEMENT

[75] Inventors: Roy King, Hemel Hempstead, United Kingdom; Roger A. Weiss, Webster; Kenneth J. Reed, Rochester, both of N.Y.; Gerald W. Klein, Issaquah, Wash.

[73] Assignee: Eastman Kodak Company, Rochester, N.Y.

[21] Appl. No.: 336,817

[22] Filed: Nov. 9, 1994

[51] Int. Cl.[6] ..... G03C 1/035; G03C 1/08

[52] U.S. Cl. ..... 430/567; 430/570; 430/600; 430/614

[58] Field of Search ..... 430/567, 570, 430/607, 614, 600

[56] References Cited

U.S. PATENT DOCUMENTS

| | | | |
|---|---|---|---|
| 3,790,390 | 2/1974 | Shiba et al. | 96/125 |
| 3,890,154 | 6/1975 | Ohkubo et al. | 96/125 |
| 4,147,542 | 4/1979 | Habu et al. | 96/27 E |
| 4,378,426 | 3/1983 | Lok et al. | 430/505 |
| 4,937,180 | 6/1990 | Marchetti et al. | 430/567 |
| 5,132,203 | 7/1992 | Bell et al. | 430/567 |
| 5,250,403 | 10/1993 | Antoniades et al. | 430/505 |
| 5,389,510 | 2/1995 | Preddy et al. | 430/614 |
| 5,413,905 | 5/1995 | Lok et al. | 430/614 |

*Primary Examiner*—Janet C. Baxter
*Attorney, Agent, or Firm*—Carl O. Thomas

[57] ABSTRACT

Improved sensitivity and reduced minimum density are provided by an emulsion in which high bromide tabular grains exhibit an average thickness of less than 0.07 μm and have latent image forming reduction chemical sensitization sites and adsorbed spectral sensitizing dye on their surfaces. The tabular grains contain a dopant capable of forming shallow electron trapping sites, and the spectral sensitizing dye exhibits an oxidation potential more positive than 1.2 volts. A photographic element is disclosed which locates the emulsion in a layer overlying a minus blue recording emulsion layer. Exceptionally sharp images are formed in the minus blue recording emulsion layer when in the overlying emulsion layer greater than 97 percent of the total projected area of the silver halide grains having an equivalent circular diameter of at least 0.2 μm is accounted for by tabular grains having an average equivalent circular diameter of at least 0.7 μm.

20 Claims, No Drawings

EMULSION AND PHOTOGRAPHIC ELEMENT

The invention is directed to in silver halide photography and, more specifically, to radiation-sensitive silver halide emulsions and to photographic elements containing silver halide emulsions.

SUMMARY OF THE DEFINITIONS

ECD is employed as an acronym for equivalent circular diameter.

The symbol "μm" is employed to denote micrometers.

In referring to grains containing two or more halides, the halides are named in order of ascending concentrations.

All periods and groups of elements are assigned based on the periodic table adopted by the American Chemical Society and published in the *Chemical and Engineering News*, Feb. 4, 1985, p. 26, except that the term "Group VIII" is employed to designate groups 8, 9 and 10.

The term "meta-chalcazole" is employed to indicate the following ring structure:

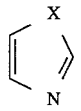

where X is one of the chalcogens: O, S or Se.

The term "dopant" refers to any material other than silver ion or halide ion incorporated within the crystal structure of a silver halide grain.

The term "minus blue" is employed in its art recognized sense to encompass the green and red portions of the visible spectrum—i.e., from 500 to 700

The term "specular light" is employed in its art recognized usage to indicate the type of spatially oriented light supplied by a camera lens to a film surface in its focal plane—i.e., light that is for all practical purposes unscattered.

The term "ultrathin" in referring to tabular grains indicates a grain thickness of <0.07 μm. In referring to tabular grain emulsions the term "ultrathin" refers to tabular grains having an average thickness of <0.07 μm.

The term "oxidized gelatin" refers to gelatin that has been treated with an oxidizing agent to reduce its methionine content below measurable levels.

PRIOR ART

Shiba et al U.S. Pat. No. 3,790,390 has as its object to provide a photographic material having a high sensitivity to blue light in flashlight exposure (i.e., reduced high intensity reciprocity failure) and that is capable of being handled in bright yellowish-green safety light. The photographic material is an emulsion comprised of (a) silver halide grains whose mean ECD is no greater than 0.9 μm; (b) $10^{-6}$ to $10^{-3}$ mole of at least one of the compounds of Group VIII metals per mole of silver halide; and (c) at least one dimethine merocyanine dye described formula.

Ohkubo et al U.S. Pat. No. 3,890,154 has as its object to provide a photographic material having a high sensitivity to green light in flashlight exposure (i.e., reduced high intensity reciprocity failure). The photographic material is an emulsion comprised of surface sensitive silver halide grains; a Group VIII metal dopant; and at least one trimethine cyanine or dimethine merocyanine dye described formulae.

Habu et al U.S. Pat. No. 4,147,542 has as its object to provide a photographic material having a high sensitivity to flashlight exposure (i.e., reduced high intensity reciprocity failure) to light of a wavelength less than 550 nm. The grains contain a Group VIII metal dopant in a concentration of from $10^{-8}$ to $5\times10^{-7}$ mole per silver mole and a zero methine merocyanine dye or monomethine cyanine dye defined by formulae.

Marchetti et al U.S. Pat. No. 4,937,180 increases emulsion stability by doping bromide grains optionally containing iodide with a hexacoordination complex of rhenium, ruthenium, osmium or iridium with at least four cyanide ligands.

Bell et al U.S. Pat. No. 5,132,203 reports increased sensitivity in silver iodobromide tabular grain emulsions in which the tabular grains have a host stratum having an iodide content of at least 4 mole percent and laminar strata forming the major faces of the tabular grains containing less than 2 mole percent iodide. A subsurface layer located immediately beneath and in contact with the surface layer contains hexacoordination complex of a Group VIII, period 4 or 5 metal and at least 3 cyanide ligands.

Lok et al U.S. Pat. Nos. 4,378,426 and 4,451,557 disclose 2-[N-(2-alkynyl)amino]-meta-chalcazoles to increase speed and reduce latent image fading in silver halide emulsions.

Antoniades et al U.S. Pat. No. 5,250,403 discloses a photographic element capable of producing images of increased image sharpness in a first emulsion layer sensitized in the 500 to 700 spectral region when overcoated with a silver iodobromide tabular grain emulsion in which >97% of the grains having an ECD of at least 0.2 μm is accounted for by tabular grains having an average ECD of at least 0.7 μm and an average thickness of less than 0.07 μm.

RELATED PATENT APPLICATIONS

Eikenberry et al U.S. Ser. No. 169,478, filed Dec. 16, 1993, commonly assigned, titled A CLASS OF COMPOUNDS WHICH INCREASES AND STABILIZES PHOTOGRAPHIC SPEED, discloses a method of finishing an emulsion comprising providing silver halide grains, adding to the emulsion in an amount between about 0.005 and 0.10 mmol/per mole of silver the compound

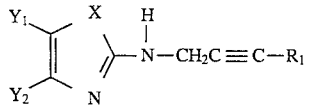

X=O, S, Se;

$R_1$=alkyl or substituted alkyl or aryl or substituted aryl;

$Y_1$ and $Y_2$ individually represent hydrogen, alkyl groups or an aromatic nucleus or together represent the atoms necessary to complete a cyclic structure containing carbon, oxygen, selenium, or nitrogen atoms necessary to complete a fused aromatic nucleus or an alicyclic structure.

Daubendiek et al U.S. Ser. No. 359,251, filed Dec. 19, 1994, as a continuation-in-part of U.S. Ser. Nos. 296,562, 297,195 and 297,430 filed Aug. 26, 1994, titled EPITAXIALLY SENSITIZED ULTRATHIN TABULAR GRAIN EMULSIONS, discloses a spectrally sensitized ultrathin tabular grain emulsion in which tabular grains (a) having {111} major faces, (b) containing greater than 70 mole percent bromide, based on silver, (c) accounting for greater than 90 percent of total grain projected area, (d) exhibiting an average equivalent circular diameter of at least 0.7 μm, (e) exhibiting an average thickness of less than 0.07 μm, and (f) having latent image forming chemical sensitization sites on the surfaces of the tabular grains, are spectrally sensitized and improved by employing in forming the surface chemical sensitization sites at least one silver salt epitaxially located on the tabular grains. In one form the tabular grains can contain a dopant providing shallow electron traps. Additionally, the emulsions can be employed to construct photographic elements of the type disclosed by Antoniades et al, cited above.

SUMMARY OF THE INVENTION

In one aspect this invention is directed to an improved radiation-sensitive emulsion comprised of a dispersing medium, silver halide grains including tabular grains (a) containing greater than 50 mole percent bromide, based on silver, (b) accounting for greater than 50 percent of total grain projected area, (c) exhibiting an average thickness of less than 0.07 μm, and (d) having latent image forming chemical sensitization sites on the surfaces of the tabular grains, and a spectral sensitizing dye adsorbed to the surfaces of the tabular grains, wherein the tabular grains contain a dopant capable of forming shallow electron trapping sites, the surface chemical sensitization sites have been formed at least in part by reduction sensitization, and the spectral sensitizing dye exhibits an oxidation potential more positive than 1.2 volts.

In another aspect this invention is directed to a photographic element comprised of a support, a first silver halide emulsion layer coated on the support and sensitized to produce a photographic record when exposed to specular light within the minus blue visible wavelength region of from 500 to 700 nm, and a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of minus blue light intended for the exposure of the first silver halide emulsion layer in the form of specular light, wherein the second silver halide emulsion layer is comprised of an improved emulsion according to the invention in which the spectral sensitizing dye exhibits peak absorption in the blue portion of the spectrum and greater than 97 percent of the total projected area of the silver halide grains having an equivalent circular diameter of at least 0.2 μm is accounted for by tabular grains having an average equivalent circular diameter of at least 0.7 μm.

It has been discovered quite unexpectedly that reduction sensitized ultrathin tabular grain emulsions exhibit reduced levels of minimum density and increased sensitivity when the tabular grains are doped to provide within the tabular grains shallow electron trapping sites and the tabular grains are spectrally sensitized with a dye having an oxidation potential above a selected level. Emulsions having performance properties inferior to those of the invention are observed when any one or combination of the following modifications are undertaken:

(a) The spectrally sensitizing dye is omitted or replaced by a dye lacking the requisite oxidation potential.

(b) The dopant is omitted, (c) The reduction sensitization is omitted.

(d) Thicker tabular grains are substituted for the ultrathin tabular grains.

It is believed that the enhanced photographic performance observed and demonstrated in the Examples below can be attributed mechanistically to the following: When an ultrathin tabular grain satisfying the requirements of the invention absorbs a photon upon imagewise exposure, the photon is initially captured by adsorbed spectrally sensitizing dye which transfers the photon energy to the grain by injecting a conduction band electron into the ultrathin tabular grain crystal lattice structure. At the same time, if the oxidation potential of the spectral sensitizing dye is sufficiently positive, a valence band electron is transferred from the ultrathin tabular grain back to the dye. This maintains the dye at charge neutrality, avoids return of the conduction band electron to the dye, and improves the efficiency of sensitization. Hence, there is no net mass transfer, but a net energy transfer has taken place. The availability of a shallow electron trapping site within the grain protects the conduction band electron from annihilation by hole-electron recombination. The reduction sensitization of the ultrathin tabular grain not only contributes to increased sensitivity but also protects the conduction band electron from annihilation by providing a surface site on the grain at which $(Ag^{\circ})_n$, $n \geqq 3$, exists. The $(Ag^{\circ})_n$ can itself donate an electron to a hole, thereby reverting to $Ag^+$. This silver bleaching that takes place on the surface of the ultrathin grain thus not only lowers minimum density, which is attributable to the presence of $(Ag^{\circ})_n$, but also increases sensitivity by decreasing the risk of hole-electron recombination.

Although the mechanistic explanation is believed to be helpful in visualizing the nature of the invention, it is an after-the-fact explanation of observed performance enhancements. The combination of the invention had never, prior to this invention, been observed and, the net effect of the combination was not predictable. For example, the bleaching of $Ag^{\circ}$ is actually undoing the reduction sensitization and could be predicted plausibly in the absence of investigation to be working against obtaining higher photographic sensitivity. Pursuing that line of reasoning an alternate dye choice would also seem to be logical. Hole injecting (electron accepting) spectral sensitizing dyes are commonly employed in direct-positive emulsions to bleach surface fog and render grains non-developable. Also beyond the scope of the mechanistic explanation are the observations of superior performance demonstrated when N-(2-alkynyl)amino-meta-chalcazoles, particularly those of Eikenberry et al, cited above, are employed as reduction sensitizers. Finally, the theory does not account for the enhanced performance of ultrathin tabular grains in the combination.

DESCRIPTION OF PREFERRED EMBODIMENTS

The invention is directed to an improvement in spectrally sensitized photographic emulsions. The emulsions are specifically contemplated for incorporation in camera speed color photographic films.

The emulsions of the invention can be realized by doping, reduction sensitizing and spectrally sensitizing in a manner described in detail below, any conventional ultrathin tabular grain emulsion in which the tabular grains (a) contain greater than 50 mole percent bromide, based on silver (preferably >70M % Br and, for moderate to high speed applications, at least 0.25M % I), (b) account for greater than 50 percent of total grain projected area (and, optionally, in further order of preference >70, >90 and >97% of total grain projected area), and (c) exhibit an average thickness of less than 0.07 μm.

An additional feature of the ultrathin tabular grain emulsions, required only for moderate to high speed imaging applications is the following:

(d) an average tabular grain ECD of at least 0.7 μm (preferably at least 1.0 μm).

Although criteria (a) through (d) are too stringent to be satisfied by the vast majority of known tabular grain emulsions, a few published precipitation techniques are capable of producing emulsions satisfying these criteria, even in their preferred forms. Antoniades et al, cited above and here incorporated by reference, demonstrates preferred silver iodobromide emulsions satisfying these criteria. Zola and Bryant published European patent application 0 362 699 A3, also discloses silver iodobromide emulsions satisfying these criteria.

For camera speed films it is generally preferred that the tabular grains contain at least 0.25 (preferably at least 1.0) mole percent iodide, based on silver. Although the saturation level of iodide in a silver bromide crystal lattice is generally cited as about 40 mole percent and is a commonly cited limit for iodide incorporation, for photographic applications iodide concentrations seldom exceed 20 mole percent and are typically in the range of from about 1 to 12 mole percent.

As is generally well understood in the art, precipitation techniques, including those of Antoniades et al and Zola and Bryant, that produce silver iodobromide tabular grain emulsions can be modified to produce silver bromide tabular grain emulsions of equal or lesser mean grain thicknesses simply by omitting iodide addition. This is specifically taught by Kofron et al U.S. Pat. No. 4,439,520.

It is possible to include minor amounts of chloride ion in the ultrathin tabular grains. As disclosed by Delton U.S. Pat. No. 5,372,971, here incorporated by reference, and Delton U.S. Ser. No. 238,119, filed May 4, 1994, (abandoned in favor of U.S. Ser. No. 304,034, filed Sep. 9, 1994, now allowed) titled CHLORIDE CONTAINING HIGH BROMIDE ULTRATHIN TABULAR GRAIN EMULSIONS, both commonly assigned, ultrathin tabular grain emulsions containing from 0.4 to 20 mole percent chloride and up to 10 mole percent iodide, based on total silver, with the halide balance being bromide, can be prepared by conducting grain growth accounting for from 5 to 90 percent of total silver within the pAg vs. temperature (° C.) boundaries of Curve A (preferably within the boundaries of Curve B) shown by Delton, corresponding to Curves A and B of Piggin et al U.S. Pat. Nos. 5,061,609 and 5,061,616, the disclosures of which are here incorporated by reference. Under these conditions of precipitation the presence of chloride ion actually contributes to reducing the thickness of the tabular grains. Although it is preferred to employ precipitation conditions under which chloride ion, when present, can contribute to reductions in the tabular grain thickness, it is recognized that chloride ion can be added during any conventional ultrathin tabular grain precipitation to the extent it is compatible with retaining tabular grain mean thicknesses of less than 0.07 μm.

As previously noted, the ultrathin tabular grains preferably contain at least 70 mole percent bromide, based on silver. These ultrathin tabular grains include silver bromide, silver iodobromide, silver chlorobromide, silver iodochlorobromide and silver chloroiodobromide grains. When the ultrathin tabular grains include iodide, the iodide can be uniformly distributed within the tabular grains. To obtain a further improvement in speed-granularity relationships it is preferred that the iodide distribution satisfy the teachings of Solberg et al U.S. Pat. No. 4,433,048, the disclosure of which is here incorporated by reference.

The ultrathin tabular grains produced by the teachings of Antoniades et al, Zola and Bryant and Delton all have {111} major faces. Such tabular grains typically have triangular or hexagonal major faces. The tabular structure of the grains is attributed to the inclusion of parallel twin planes.

The tabular grains of the emulsions of the invention preferably account for greater than 70 percent of total grain projected area and, most preferably, greater than 90 percent of total grain projected area. Ultrathin tabular grain emulsions in which the tabular grains account for greater than 97 percent of total grain projected area can be produced by the preparation procedures taught by Antoniades et al and are preferred. Antoniades et al reports emulsions in which substantially all (e.g., up to 99.8%) of total grain projected area is accounted for by tabular grains. Similarly, Delton reports that "substantially all" of the grains precipitated in forming the ultrathin tabular grain emulsions were tabular. Providing emulsions in which the tabular grains account for a high percentage of total grain projected area is important to achieving the highest attainable image sharpness levels, particularly in multilayer color photographic films. It is also important to utilizing silver efficiently and to achieving the most favorable speed-granularity relationships.

The tabular grains preferably exhibit an average ECD of at least 0.7 μm. The advantage to be realized by maintaining the average ECD of at least 0.7 μm is demonstrated in Tables III and IV of Antoniades et al. Although emulsions with extremely large average grain ECD's are occasionally prepared for scientific grain studies, for photographic applications ECD's are conventionally limited to less than 10 μm and in most instances are less than 5 μm. An optimum ECD range for moderate to high image structure quality is in the range of from 1 to 4 μm.

In the ultrathin tabular grain emulsions of the invention the tabular grains accounting for greater than 50 percent of total grain projected area exhibit a mean thickness of less than 0.07 μm. At a mean grain thickness of less than 0.07 μm there is little variance between reflectance in the green and red regions of the spectrum. Additionally, compared to tabular grain emulsions with mean grain thicknesses in the 0.08 to 0.20 μm range, differences between minus blue and blue reflectances are not large. This decoupling of reflectance magnitude from wavelength of exposure in the visible region simplifies film construction in that green and red recording emulsions (and to a lesser degree blue recording emulsions) can be constructed using the same or similar tabular grain emulsions. If the mean thicknesses of the tabular grains are further reduced below 0.07 μm, the average reflectances observed within the visible spectrum are also reduced. Therefore, it is preferred to maintain mean grain thicknesses at less than 0.05 μm. Generally the lowest mean tabular grain thickness conveniently realized by the precipitation process employed is preferred. Thus, ultrathin tabular grain emulsions with mean tabular grain thicknesses in the range of from about 0.03 to 0.05 μm are readily realized. Daubendiek et al U.S. Pat. No. 4,672,027 reports mean tabular grain thicknesses of 0.017 μm. Utilizing the grain growth techniques taught by Antoniades et al these emulsions could be grown to average ECD's of at least 0.7 μm without appreciable thickening—e.g., while maintaining mean thicknesses of less than 0.02 μm. The minimum thickness of a tabular grain is limited by the spacing of the first two parallel twin planes formed in the grain during precipitation. Although minimum twin plane spacings as low as 0.002 μm (i.e., 2 nm or 20 Å) have been observed in the emulsions of Antoniades et al, Kofron et al suggests a practical minimum tabular grain thickness about 0.01 μm.

Preferred ultrathin tabular grain emulsions are those in which grain to grain variance is held to low levels. Antoniades et al reports ultrathin tabular grain emulsions in which greater than 90 percent of the tabular grains have hexagonal major faces. Antoniades also reports ultrathin tabular grain emulsions exhibiting a coefficient of variation (COV) based on ECD of less than 25 percent and even less than 20 percent.

It is recognized that both photographic sensitivity and granularity increase with increasing mean grain ECD. From comparisons of sensitivities and granularities of optimally sensitized emulsions of differing grain ECD's the art has established that with each doubling in speed (i.e., 0.3 log E increase in speed, where E is exposure in lux-seconds) emulsions exhibiting the same speed-granularity relationship will incur a granularity increase of 7 granularity units.

It has been observed that the presence of even a small percentage of larger ECD grains in the ultrathin tabular grain emulsions of the invention can produce a significant increase in emulsion granularity. Antoniades et al preferred low COV emulsions, since placing restrictions on COV necessarily draws the tabular grain ECD's present closer to the mean.

It is here recognized that COV is not the best approach for judging emulsion granularity. Requiring low emulsion COV values places restrictions on both the grain populations larger than and smaller than the mean grain ECD, whereas it is only the former grain population that is driving granularity to higher levels. The art's reliance on overall COV measurements has been predicated on the assumption that grain size-frequency distributions, whether widely or narrowly dispersed, are Gaussian error function distributions that are inherent in precipitation procedures and not readily controlled.

It is specifically contemplated to modify the ultrathin tabular grain precipitation procedures taught by Antoniades et al to decrease selectively the size-frequency distribution of the ultrathin tabular grains exhibiting an ECD larger than the mean ECD of the emulsions. Because the size-frequency distribution of grains having ECD's less than the mean is not being correspondingly reduced, the result is that overall COV values are not appreciably reduced. However, the advantageous reductions in emulsion granularity have been clearly established.

It has been observed that disproportionate size range reductions in the size-frequency distributions of ultrathin tabular grains having greater than mean ECD's (hereinafter referred to as the $>ECD_{av.}$grains) can be realized by modifying the procedure for precipitation of the ultrathin tabular grain emulsions in the following manner: Ultrathin tabular grain nucleation is conducted employing gelatino-peptizers that have not been treated to reduce their natural methionine content while grain growth is conducted after substantially eliminating the methionine content of the gelatino-peptizers present and subsequently introduced. A convenient approach for accomplishing this is to interrupt precipitation after nucleation and before growth has progressed to any significant degree to introduce a methionine oxidizing agent.

Any of the conventional techniques for oxidizing the methionine of a gelatino-peptizer can be employed. Maskasky U.S. Pat. No. 4,713,320, here incorporated by reference, teaches to reduce methionine levels by oxidation to less than 30 μmoles, preferably less than 12 μmoles, per gram of gelatin by employing a strong oxidizing agent. In fact, the oxidizing agent treatments that Maskasky employ reduce methionine below detectable limits. Examples of agents that have been employed for oxidizing the methionine in gelatino-peptizers include NaOCl, chloramine, potassium monopersulfate, hydrogen peroxide and peroxide releasing compounds, and ozone. King et al U.S. Pat. No. 4,942,120, here incorporated by reference, teaches oxidizing the methionine component of gelatino-peptizers with an alkylating agent. Takada et al published European patent application 0 434 012 discloses precipitating in the presence of a thiosulfate of one of the following formulae:

$$R—SO_2S—M \quad (I)$$

$$R—SO_2S—R^1 \quad (II)$$

$$R—SO_2S—Lm\text{-}SSO_2R^2 \quad (III)$$

where R, $R^1$ and $R^2$ are either the same or different and represent an aliphatic group, an aromatic group, or a heterocyclic group, M represents a cation, L represents a divalent linking group, and m is 0 or 1, wherein R, $R^1$, $R^2$ and L combine to form a ring. Gelatino-peptizers include gelatin—e.g., alkali-treated gelatin (cattle, bone or hide gelatin) or acid-treated gelatin (pigskin gelatin) and gelatin derivatives, e.g., acetylated or phthalated gelatin.

It is an essential feature of the invention to incorporate in the face centered cubic crystal lattice of the tabular grains a dopant capable of increasing photographic speed by forming shallow electron traps. To create a latent image site within or, more typically, at the surface of the grain, a plurality of photoelectrons (electrons elevated to the conduction band of the crystal lattice) produced in a single imagewise exposure must reduce several silver ions in the crystal lattice to form a small cluster of $Ag^{\circ}$ atoms. To the extent that photoelectrons are dissipated by competing mechanisms before the latent image can form, the photographic sensitivity of the silver halide grains is reduced. For example, if the photoelectron returns to a hole in the valence band, its energy is dissipated without contributing to latent image formation.

It is contemplated to dope the silver halide to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics*, Vol. 37 (1988) p. 395 and Excitonic *Processes in Solids* by M. Ueta, H. Kanzaki, K. Kobayashi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still, allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: lanthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt U.S. Pat. No. 2,628,167, Gilman et al U.S. Pat. No. 3,761,267, Atwell et al U.S. Pat. No. 4,269,927, Weyde et al U.S. Pat. No. 4,413,055 and Murakima et al EPO 0 590 674 and 0 563 946, each here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectro-chemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of ligands in the spectrochemical series is apparent:

$$I^- < Br^- < S^{-2} < \underline{S}CN^- < Cl^- < NO_3^- < F^- < \underline{O}H$$
$$< ox^{-2} < H_2\underline{O} < \underline{N}CS^- < CH_3C\underline{N}^- < \underline{N}H_3 < en < dipy$$
$$< phen < \underline{N}O_2^- < phosph << \underline{C}N^- < \underline{C}O.$$

The abbreviations used are as follows: en=ethylenediamine, ox=oxalate, dipy=dipyridine, phen=o-phenathroline, and phosph=4-methyl-2,6,7-trioxa-1-phosphabicyclo[2.2.2] octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $CN^-$ and CO are especially preferred. Other preferred ligands are thiocyanate ($NCS^-$), selenocyanate ($NCSe^-$), cyanate ($NCO^-$), tellurocyanate ($NCTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2} < Ni^{+2} < Co^{+2} < Fe^{+2} < Cr^{+3}$$
$$\approx V^{+3} < Co^{+3} < Mn^{+4} < Mo^{+3} < Rh^{+3}$$
$$\approx Ru^{+3} < Pd^{+4} < Ir^{+3} < Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, Fe(II) $(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes, they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experimental Techniques,* 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi* (b), Vol. 152 (1989), pp. 583–592, in a AgCl crystal the g factor of the electron EPR signal is 1.88± 0.001 and in AgBr it is 1.49±0.02.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a 0.45±0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN_6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20°, 40° and 60° K., respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are preferred coordination complexes for use in the practice of this invention. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion in the protrusions are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-2[1990]-249588, the disclosures of which are here incorporated by reference. Useful neutral and anionic organic ligands for hexacoordination complexes are disclosed by Olm et al U.S. Pat. No. 5,360,712, the disclosure of which is here incorporated by reference.

Careful scientific investigations have revealed Group VIII hexahalo coordination complexes to create deep (desensitizing) electron traps, as illustrated R. S. Eachus, R. E. Graves and M. T. Olm *J. Chem. Phys.*, Vol. 69, pp. 4580–7 (1978) and *Physica Status Solidi* A, Vol. 57, 429–37 (1980).

In a specific, preferred form it is contemplated to employ as a dopant a hexacoordination complex satisfying the formula:

$$[ML_6]^n \qquad \text{(IV)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)(CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[Ir(CN)_4(oxalate)]^{-3}$ |
| SET-26 | $[In(NCS)_6]^{-3}$ |
| SET-27 | $[Ga(NCS)_6]^{-3}$ |

Any conventional concentration of the shallow electron trap forming dopants can be employed. Generally shallow electron trap forming dopants are contemplated to be incorporated in concentrations of at least $1\times10^{-6}$ mole per silver mole up to their solubility limit, typically up to about $5\times10^{-4}$ mole per silver mole. Preferred concentrations are in the range of from about $10^{-5}$ to $10^{-4}$ mole per silver mole.

If all of the dopant is introduced into the dispersing medium prior to tabular grain nucleation, an unwanted thickening of the tabular grains can result or, in the extreme, an unwanted, nontabular grain population may form. It is therefore preferred to defer dopant introduction until grain nucleation has been completed. That is, dopant introduction is preferably delayed until the transition has occurred from new grain formation to growth of existing grains. For a typical well controlled precipitation the transition from grain formation to existing grain growth has occurred before 0.2 percent of total silver forming the tabular grains has been introduced into the dispersing medium.

It is specifically contemplated as one alternative to distribute the dopant uniformly through the tabular grains. If the dopant is introduced concurrently with silver and at all times held within the overall concentration ranges noted above, the concentration of the dopant during grain nucleation is sufficiently low to be compatible with ultrathin tabular grain formation.

In a preferred form of the invention the dopant is introduced concurrently with silver, most preferably commencing just after grain nucleation, but the dopant addition is accelerated so that it is completed before grain growth is completed. It has been observed that a further increase in photographic sensitivity can be realized when dopant introduction is completed during introduction of the first 50 percent, most preferably the first 25 percent, of total silver precipitated in forming the tabular grains.

Only a dopant which acts to provide shallow electron trapping sites is required in the ultrathin tabular grain emulsions of the invention. However, any other conventional dopant that is not incompatible with the function of providing shallow electron trapping sites and maintaining ultrathin tabular grain thicknesses can be introduced. Conventional dopants and their functions are summarized in *Research Disclosure*, Vol. 365, September 1994, Item 36544, I. Emulsion grains and their precipitation, D. Grain modifying conditions and adjustments, paragraphs (3)–(5). *Research Disclosure* is published by Kenneth Mason Publications, Ltd., Dudley House, 12 North St., Emsworth, Hampshire P010 7DQ, England.

The internally doped ultrathin tabular grain emulsions can be reduction sensitized in any convenient conventional manner. Conventional reduction sensitizations are summarized in *Research Disclosure*, Item 36544, cited above, IV. Chemical sensitization, paragraph (1). A specifically preferred class of reduction sensitizers are the 2-[N-(2-alkynyl)amino]-meta-chalcazoles disclosed by Lok et al U.S. Pat. Nos. 4,378,426 and 4,451,557, the disclosures of which are here incorporated by reference.

Preferred 2-[N-(2-alkynyl)amino]-meta-chalcazoles can be represented by the formula:

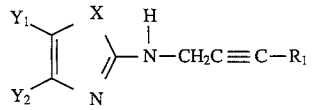

(V)

where

X=O, S, Se;

$R_1$=(Va) hydrogen or (Vb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

As disclosed by Eikenberry et al, cited above, the formula (V) compounds are generally effective (with the (Vb) form giving very large speed gains and exceptional latent image stability) when present during the heating step (finish) that results in chemical sensitization.

In a preferred form of the invention, an alkynylamino substituent is attached to a benzoxazole, benzothiazole or benzoselenazole nucleus. In one specific preferred form, the compounds Va and Vb can be represented by the following formula:

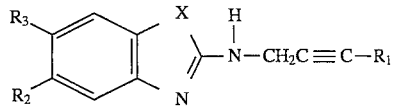

(VI)

where

VIa —$R_1$=H

VIa1 —$R_1$=H, $R_2$=H, X=O

VIa2 —$R_1$=H, $R_2$=Me, X=O

VIa3 —$R_1$=H, $R_2$=H, X=S

VIb —$R_1$=alkyl or aryl

VIb1 —$R_1$=Me, $R_2$=H, X=O $R_3$=H

VIb2 —$R_1$=Me, $R_2$=Me, X=O $R_3$=H

VIb3 —$R_1$=Me, $R_2$=H, X=S $R_3$=H

VIb4 —$R_1$=Ph, $R_2$=H, X=O $R_3$=H

Other preferred VIb structures have $R_1$ as ethyl, propyl, p-methoxyphenyl, p-tolyl, or p-chlorophenyl with $R_2$ or $R_3$ as halogen, methoxy, alkyl or aryl.

Whereas previous work employing compounds with structure similar to Va and Vb described speed gains of about 40% using 0.10 mmole/silver mole when added after sensitization and prior to forming the layer containing the emulsion (Lok et al U.S. Pat. No. 4,451,557), speed gains have been demonstrated by Eikenberry et al ranging from 66% to over 250%, depending on the emulsion and sensitizing dye utilized, by adding 0.02–0.03 mmole/silver mole of Vb during the sensitization step. Significantly higher levels of fog are observed when the Va compounds are employed.

The Vb compounds of the present invention typically contains an $R_1$ that is an alkyl or aryl. It is preferred that the $R_1$ be either a methyl or a phenyl ring for the best increase in speed and latent image keeping.

The compounds of the invention are added to the silver halide emulsion at a point subsequent to precipitation to be present during the finish step of the chemical sensitization process. A preferred concentration range for [N-(2-alkynyl)-amino]-meta-chalcazole incorporation in the emulsion is in the range of from 0.002 to 0.2 (most preferably 0.005 to 0.1) mmole per mole of silver. In a specifically preferred form of the invention [N-(2-alkynyl)amino]-meta-chalcazole reduction sensitization is combined with conventional gold (or platinum metal) and/or middle (S, Se or Te) chalcogen sensitizations. These sensitizations are summarized in *Research Disclosure* Item 36544, previously cited, IV. Chemical sensitization. The combination of sulfur, gold and [N-(2-alkynyl)amino]-meta-chalcazole reduction sensitization is specifically preferred.

A specifically preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

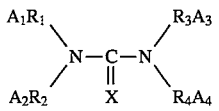

(VII)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form.

A specifically preferred tetrasubstituted thiourea sensitizer is 1,3-dicarboxymethyl-1,3-dimethylthiourea.

Specifically preferred gold sensitizers are the gold(I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(VIII)}$$

wherein

L is a mesoionic compound;

X is an anion; and $L^1$ is a Lewis acid donor.

Any conventional spectral sensitizing dye having an oxidation potential more positive than +1.2 volts, preferably more positive than +1.4 volts, can be employed in the practice of the invention. As previously noted, the large positive value of the oxidation potential facilitates acceptance of a valence band electron from the grain. Dye oxidation and reduction potentials can be measured as described by R. J. Cox, *Photographic Sensitivity*, Academic Press, 1973, Chapter 15. Sensitizing action has been correlated to the position of molecular energy levels of a dye with respect to ground state and conduction band energy levels of the silver halide crystals. These energy levels have in turn been correlated to polarographic oxidation and reduction potentials, as discussed in *Photographic Science and Engineering*, Vol. 18, 1974, pp. 49–53 (Sturmer et al), pp. 175–178 (Leubner) and pp. 475–485 (Gilman). It is generally accepted that those dyes which are spectral sensitizers for high bromide silver halide emulsions exhibit a reduction potential more negative than −1.1. volts (e.g., see James *The Theory of the Photographic Process,* 4th Ed., Macmillan, New York, 1977, p. 277).

The oxidation and reduction potentials have been correlated to maximum absorption wavelength of the dye (e.g., see James, cited above, p. 204, and Dobles et al EPO 0 472 004). The following relationship is generally accepted:

$$\lambda_{max} = \frac{1240}{Es} \quad \text{(IX)}$$

where $\lambda_{max}$ represents the maximum absorption wavelength of the dye;

$Es = E_{ox} - E_{red}$;

$E_{ox}$ is the oxidation potential of the dye in volts; and $E_{red}$ is the reduction potential of the dye in volts.

From relationship (IX) it is apparent that the sensitizing dyes cannot exhibit a maximum absorption wavelength longer than about 535 nm. The majority of the spectral sensitizing dyes satisfying the requirements of the invention exhibit maximum absorption wavelengths in the blue portion of the spectrum.

A specifically preferred class of spectral sensitizing dyes satisfying the requirements of the invention are monomethine cyanine dyes.

The monomethine cyanine spectral sensitizing dyes include, joined by a single methine group, two basic heterocyclic nuclei, such as those derived from quinolinium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium, dihydronaphthothiazolium, pyrylium and imidazopyrazinium quaternary salts.

A detailed summary of conventional spectral sensitizing dyes and their incorporation into silver halide emulsions is provided in *Research Disclosure*, Item 36544, previously cited, V. Spectral sensitization and desensitization A. Sensitizing dyes. When combinations of spectral sensitizing dyes are employed, only one of the dyes need exhibit an oxidation of potential more positive than +1.2 volts, but preferably all of the spectral sensitizing dyes exhibit oxidation potentials more positive than this value.

The following is a listing of spectral preferred sensitizing dyes useful in the practice of the invention and their oxidation potentials:

D-1 Anhydro-3,3'-bis(3-sulfopropyl)-5,5'-diphenyloxacyanine hydroxide, sodium salt ($E_{ox}$ +1.425 V);

-continued

| | |
|---|---|
| D-2 | Anhydro-3,3'-bis(3-sulfopropyl)-5-chloro-5'-phenyloxacyanine hydroxide, sodium salt ($E_{ox}$ +1.459 V); |
| D-3 | Anhydro-5'-chloro-3,3'-bis(3-sulfo-propyl)-5-phenyloxathiacyanine hydroxide, sodium salt ($E_{ox}$ +1.447 V); |
| D-4 | Anhydro-3,3'-bis(3-sulfopropyl)-5,5'-dichloro-thiacyanine hydroxide, triethylammonium salt ($E_{ox}$ +1.469 V) |
| D-5 | 5,5'-Dichloro-3,3'-diethylthiacarbocyanine iodide ($E_{ox}$ +1.425 V) |
| D-6 | Anhydro-5-bromo-3'-(2-carboxyallyl)-5'-chloro-3-ethylthiacyanine, hydroxide inner salt ($E_{ox}$ +1.483 V) |
| D-7 | Anhydro-5'-chloro-3'-(3-sulfopropyl)-3-ethyl-selenathiacyanine, hydroxide inner salt ($E_{ox}$ +1.423 V) |
| D-8 | Anhydro-5,6-benzo-3-ethyl-3'-(2-sulfoethylcarbam-oyl)thiacyanine, hydroxide, inner salt ($E_{ox}$ +1.461 V) |
| D-9 | 3,3'-diethyl-5-iodothiacyanine bromide ($E_{ox}$ +1.460 V) |
| D-10 | 1,1',3,3'-Tetraethylimidazo[4,5-b]quinoxolino-cyanine p-toluenesulfonate ($E_{ox}$ +1.411 V) |

Aside from the features of the emulsions of this invention and their preparation and their preparation described above, the emulsions can take any desired conventional form. For example, although not essential, after a novel emulsion satisfying the requirements of the invention has been prepared, it can be blended with one or more other novel emulsions according to this invention or with any other conventional emulsion. Conventional emulsion blending is illustrated in *Research Disclosure*, Item 36544, cited above. I. Emulsion grains and their preparation E. Blends, layers and performance categories.

The emulsions once formed can be further prepared for photographic use by any convenient conventional technique. Additional conventional features are illustrated by *Research Disclosure* Item 36544, cited above, II. Vehicles, vehicle extenders, vehicle-like addenda and vehicle-related addenda; III. Emulsion washing; VII. Antifoggants and stabilizers; VIII. Absorbing and scattering materials; IX. Coating physical property modifying agents; and X. Dye image formers and modifiers. The features of VIII-X can alternatively be provided in other photographic element layers.

The novel epitaxial silver salt sensitized ultrathin tabular grain emulsions of this invention can be employed in any otherwise conventional photographic element. The emulsions can, for example, be included in a photographic element with one or more silver halide emulsion layers. In one specific application a novel emulsion according to the invention can be present in a single emulsion layer of a photographic element intended to form either silver or dye photographic images for viewing or scanning.

In one important aspect this invention is directed to a photographic element containing at least two superimposed radiation sensitive silver halide emulsion layers coated on a conventional photographic support of any convenient type. Exemplary photographic supports are summarized by *Research Disclosure*, Item 36544, cited above, Section XV. The emulsion layer coated nearer the support surface is spectrally sensitized to produce a photographic record when the photographic element is exposed to specular light within the minus blue portion of the visible spectrum.

The second of the two silver halide emulsion layers is coated over the first silver halide emulsion layer. In this arrangement the second emulsion layer is called upon to perform two-entirely different photographic functions. The first of these functions is to absorb at least a portion of the light wavelengths it is intended to record. The second emulsion layer can record light in either the blue or green spectral region. In a specifically preferred application the second emulsion layer records light in the blue portion of the spectrum. Regardless of the wavelength of recording contemplated, the ability of the second emulsion layer to provide a favorable balance of photographic speed and image structure (i.e., granularity and sharpness) is important to satisfying the first function.

The second distinct function which the second emulsion layer must perform is the transmission of minus blue light intended to be recorded in the first emulsion layer. Whereas the presence of silver halide grains in the second emulsion layer is essential to its first function, the presence of grains, unless chosen as required by this invention, can greatly diminish the ability of the second emulsion layer to perform satisfactorily its transmission function. Since an overlying emulsion layer (e.g., the second emulsion layer) can be the source of image unsharpness in an underlying emulsion layer (e.g., the first emulsion layer), the second emulsion layer is hereinafter also referred to as the optical causer layer and the first emulsion is also referred to as the optical receiver layer.

How the overlying (second) emulsion layer can cause unsharpness in the underlying (first) emulsion layer is explained in detail by Antoniades et al, incorporated by reference, and hence does not require a repeated explanation.

It has been discovered that a favorable combination of photographic sensitivity and image structure (e.g., granularity and sharpness) are realized when ultrathin tabular grain emulsions satisfying the requirements of the invention are employed to form at least the second, overlying emulsion layer. Obtaining sharp images in the underlying emulsion layer is dependent on the ultrathin tabular grains in the overlying emulsion layer accounting for a high proportion of total grain projected area; however, grains having an ECD of less than 0.2. μm, if present, can be excluded in calculating total grain projected area, since these grains are relatively optically transparent. Excluding grains having an ECD of less than 0.2 μm in calculating total grain projected area, it is preferred that the overlying emulsion layer containing the ultrathin tabular grain emulsion of the invention account for greater than 97 percent, preferably greater than 99 percent, of the total projected area of the silver halide grains.

Except for the possible inclusion of grains having an ECD of less than 0.2 μm (hereinafter referred to as optically transparent grains), the second emulsion layer consists almost entirely of ultrathin tabular grains. The optical transparency to minus blue light of grains having ECD's of less 0.2 μm is well documented in the art. For example, Lippmann emulsions, which have typical ECD's of from less than 0.05 μm to greater than 0.1 μm, are well known to be optically transparent. Grains having ECD's of 0.2 μm exhibit significant scattering of 400 nm light, but limited scattering of minus blue light. In a specifically preferred form of the invention the tabular grain projected areas of greater than 97% and optimally greater than 99% of total grain projected area are satisfied excluding only grains having ECD's of less than 0.1 (optimally 0.05) μm. Thus, in the photographic elements of the invention, the second emulsion layer can consist essentially of tabular grains contributed by the ultrathin tabular grain emulsion of the invention or a blend of these tabular grains and optically transparent grains. When optically transparent grains are present, they are preferably limited to less than 10 percent and optimally less than 5 percent of total silver in the second emulsion layer.

The advantageous properties of the photographic elements of the invention depend on selecting the grains of the emulsion layer overlying a minus blue recording emulsion layer to have a specific combination of grain properties. First, the tabular grains preferably contain photographically significant levels of iodide. The iodide content imparts art recognized advantages over comparable silver bromide emulsions in terms of speed and, in multicolor photography, in terms of interimage effects. Second, having an extremely high proportion of the total grain population as defined above accounted for by the tabular grains offers a sharp reduction in the scattering of minus blue light when coupled with an average ECD of at least 0.7 μm and an average grain thickness of less than 0.07 μm. The mean ECD, of at least 0.7 μm is, of course, advantageous apart from enhancing the specularity of light transmission in allowing higher levels of speed to be achieved in the second emulsion layer. Third, employing ultrathin tabular grains makes better use of silver and allows lower levels of granularity to be realized. Finally, the emulsion features described in detail above allow unexpected increases in photographic sensitivity to be realized.

In one simple form the photographic elements can be black-and-white (e.g., silver image forming) photographic elements in which the underlying (first) emulsion layer is orthochromatically or panchromatically sensitized.

In an alternative form the photographic elements can be multicolor photographic elements containing blue recording (yellow dye image forming), green recording (magenta dye image forming) and red recording (cyan dye image forming) layer units in any coating sequence. A wide variety of coating arrangements are disclosed by Kofron et al, cited above, columns 56–58, the disclosure of which is here incorporated by reference.

EXAMPLES

The invention can be better appreciated by reference to following specific examples of emulsion preparations, emulsions and photographic elements satisfying the requirements of the invention. Photographic speeds are reported as relative log speeds, where a speed difference of 30 log units equals a speed difference of 0.3 log E, where E represents exposure in lux-seconds. Contrast (γ) was measured as mid-scale contrast.

Emulsion Preparations

The following general procedure was employed in the preparation of all of the emulsions described below: A reaction was initially charged with 1.5 g/L of oxidized gelatin, 0.7148 g/L NaBr and then adjusted to a pH of 2.5. Nucleation occurred at 35° C. over a period of 0.21 minute using a double jet procedure flowing 2.5N silver nitrate and a mixed halide salt consisting of 2.4625N NaBr and 0.375N KI. A ripening segment lasting 15 minutes was then initiated using ammonium sulfate at pH 10.0 in the presence of 100 mL of Oxone™ ($2KHSO_5 \cdot KHSO_4 \cdot K_2SO_4$). Oxidized gelatin was added to bring the gelatin concentration to 10.5 g/L and then the pH was brought to 5.8 to terminate ripening. Preparation for subsequent growth segments was made by a temperature increase to 45° C. and the addition of NaBr to a final concentration of 2.1736 g/L. Post-nucleation growth segments employed in addition to the silver and halide jets a third jet for introducing a AgI Lippmann emulsion. The Lippmann silver introduction was regulated to 1.5%, based on silver being introduced through the silver jet. Five growth segments, each employing a higher rate of silver introduction than that preceding were employed, accounting for 0.2 to 15.4%, 15.4 to 41.8%, 41.8 to 81.3% and 81.3 to 95% of cumulative silver introduced. The final 5% of silver was introduced without concurrent iodide introduction.

The emulsions were either undoped or differently doped during preparation as reported below. Doping had minimal impact on the physical characteristics of the grains precipitated. Tabular grains accounted for >90% of total grain projected area. The mean ECD's of the emulsions ranged from 1.44 to 1.50 μm. The mean thicknesses of the tabular grains ranged from 0.0505 to 0.0524 μm.

Emulsion Sensitizations

Optimum sensitizations were, on a per mole silver basis, as follows: 200 mg of NaSCN, 1.365 mmole of spectral sensitizing dye anhydro-5',6'-dichloro-1' -ethyl-3,3'-bis(3-sulfopropyl)naphth[1,2-d]oxazolobenzimidazolocyanine hydroxide, triethylammonium salt (λmax <450 nm), and 1.2 mmole of spectral sensitizing dye D-4 (λmax 470 nm) were added. Then 6.7 mg of the reduction sensitizer [N-(2-butynyl)amino]-meta-benzoxazole, hereinafter designated R-1, were added to the melt. This was followed by chemical sensitization with 10.4 mg of 1,3-dicarboxymethyl-1,3-diethylthiourea and 8.32 mg of aurous bis(1,4,5-trimethyl-1,2,4-triazolium-3-thiolate) tetrafluoroborate. The temperature of the emulsion was increased from 40° C. to 55° C., where it was held for 15 minutes and then returned to 40° C. The antifoggant 5-bromo-4-hydroxy-6-methyl-1,3,3A,7-tetraazaindene was then added to the melt at a level of 1.6 grams.

Emulsion Coatings

Each emulsion was coated in a single layer format on a photographic cellulose acetate film base with an antihalation backing layer for evaluation as follows: The emulsion layer contained 5.38 mg/dm$^2$ silver as silver halide, 21.52 mg/dm$^2$ gelatin, 0.43 mg/dm$^2$ of calcium nitrate surfactant, 13.67 mg/dm$^2$ of the yellow dye image-forming coupler N-{2-chloro-5[(hexadecylsulfonyl)amino]phenyl}-2-{4-[(4-hydroxyphenyl)sulfonyl]phenoxy}-4,4-dimethyl-3-oxopentanamide, 0.33 mg/dm$^2$ of the development inhibiting coupler

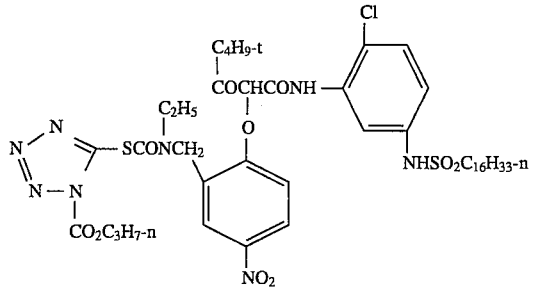

A gelatin overcoat of 21.52 mg/dm$^2$ was then coated with 1.75% bis(vinylsulfonyl)methane, based on total weight of gelatin in the emulsion and overcoat layers.

Exposure and Processing

The coatings were each exposed for 1/50th of a second at 5500° K. light source filtered through a Wrattan™ WR-2B filter, which absorbed light at wavelengths shorter than 390 nm. The exposed coatings received Kodak Flexicolor™ C-41 color negative processing using a 3 minutes 15 seconds development.

Dopant and Sensitization Variations

The shallow electron trapping dopant $K_4Ru(CN)_6$, herein designated SET-1, was added at various locations and concentrations to different emulsion preparations and also withheld entirely to demonstrate control emulsion performance. Also the reduction sensitizer R-1 was withheld in some instances to demonstrate its contribution to the overall performance of the emulsions of the invention.

The advantages realized by employing the dopant and reduction sensitizer together in the ultra-thin tabular grain emulsion is demonstrated in Table I.

TABLE I

| Emulsion | SET-1 (mppm) | R-1 (mg/mole) | Dmin | γ | Log Speed |
|---|---|---|---|---|---|
| A(control) | 0 | 0 | 0.057 | 1.73 | 214 |
| B(control) | 100 | 0 | 0.053 | 1.60 | 229 |
| C(control) | 0 | 6.7 | 0.127 | 1.66 | 248 |
| D(example) | 100 | 6.7 | 0.110 | 1.56 | 256 |

The dopant SET-1 was introduced uniformly over the four growth segments of precipitation.

Control Emulsion A lacking both reduction sensitization and the shallow electron trapping dopant exhibited the lowest observed photographic speed. When the dopant was employed without the reduction sensitizer, a one half stop (0.15 log E) speed increase was observed without any increase in minimum density. When the reduction sensitizer was employed without dopant, a full stop increase in speed was observed, but with an objectionable increase in minimum density.

Based on the performance of the controls it was unexpected that an even higher speed increase (0.42 log E, nearly one and one half stops) could be realized while lowering the minimum density below that observed employing the reduction sensitizer without dopant. Thus, the emulsion of the invention, Emulsion D, demonstrated an unexpected advantage in speed and lowered minimum density.

To demonstrate the effect of varied dopant levels the following variations of Emulsion B with varied dopant incorporations as described above are reported in Table II.

TABLE II

| Emulsion | SET-1 (mppm) | Dmin | γ | Log Speed |
|---|---|---|---|---|
| E | 0 | 0.065 | 1.74 | 247 |
| F | 25 | 0.075 | 1.62 | 257 |
| G | 100 | 0.073 | 1.58 | 263 |

From Table II it is apparent that the shallow electron trapping dopant increased speed progressively with increasing concentrations, but minimum density was not increased in increasing dopant concentrations above 25 mppm.

In Table III below a series of emulsions are compared that received reduction sensitization and various levels and placements of dopant.

TABLE III

| Emulsion | SET-1 (mppm) | Placement (% Ag) | Dmin | γ | Log Speed |
|---|---|---|---|---|---|
| H | 0 | 0 | 0.09 | 1.62 | 250 |
| I | 25 | 0.2–95 | 0.09 | 1.63 | 260 |
| J | 100 | 0.2–95 | 0.10 | 1.59 | 248 |
| K | 500 | 6.7 | 0.12 | 1.56 | 264 |

TABLE III-continued

| Emulsion | SET-1 (mppm) | Placement (% Ag) | Dmin | γ | Log Speed |
|---|---|---|---|---|---|
| L | 100 | 81–95 | 0.09 | 1.61 | 258 |
| M | 300 | 81–95 | 0.09 | 1.58 | 260 |
| N | 100 | 15–42 | 0.11 | 1.60 | 268 |
| O | 300 | 42–81 | 0.09 | 1.62 | 263 |
| P | 100 | 0.2–15 | 0.09 | 1.62 | 261 |
| Q | 300 | 0.2–15 | 0.11 | 1.62 | 270 |
| R | 500 | 0.2–15 | 0.12 | 1.65 | 268 |

From Table III it is apparent that the lowest speed reduction sensitized emulsion was that which contained no dopant. The shallow electron trapping dopant increased speed at every location and concentration observed. The top speeds observed occurred when dopant addition occurred before 50 percent of total silver had been precipitated. The dopant had little effect on minimum density and contrast.

The invention has been described in detail with particular reference to preferred embodiments thereof, but it will be understood that variations and modifications can be effected within the spirit and scope of the invention.

What is claimed is:

1. A radiation-sensitive emulsion comprised of a dispersing medium, silver halide grains including tabular grains, said tabular grains (a) containing greater than 50 mole percent bromide, based on silver, (b) accounting for greater than 50 percent of total grain projected area, (c) exhibiting an average thickness of less than 0.07 μm, and (d) having latent image forming chemical sensitization sites on the surfaces of the tabular grains, and a spectral sensitizing dye adsorbed to the surfaces of the tabular grains, wherein the tabular grains contain a dopant capable of forming shallow electron trapping sites, the surface chemical sensitization sites have been formed at least in part by reduction sensitization with a compound of the formula:

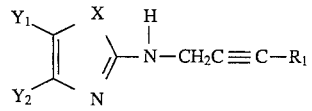

where $R_1$=hydrogen, alkyl or aryl and

X, $Y_1$ and $Y_2$ together represent the atoms necessary to complete a benzoxazole, benxothiazole or benzoselenazole nucleus, and the spectral sensitizing dye exhibits an oxidation potential more positive than 1.2 volts.

2. An emulsion according to claim 1 wherein the tabular grains exhibit an average equivalent circular diameter of at least 0.7 μm.

3. An emulsion according to claim 2 wherein the tabular grains exhibit an average equivalent circular diameter of at least 1.0 μm.

4. An emulsion according to claim 1 wherein the tabular grains account for greater than 70 percent of total grain projected area.

5. An emulsion according to claim 1 wherein the tabular grains account for greater than 90 percent of total grain projected area.

6. An emulsion according to claim 1 wherein the tabular grains account for greater than 97 percent of total grain projected area.

7. An emulsion according to claim 1 wherein the tabular grains are comprised of greater than 70 mole percent bromide, based on silver.

8. An emulsion according to claim 7 wherein the tabular grains include at least 0.25 mole percent iodide, based on silver.

9. An emulsion according to claim 8 wherein the tabular grains are silver iodobromide grains.

10. An emulsion according to claim 1 wherein the dopant is located in the portion of the tabular grains containing a first precipitated 50 percent of the silver.

11. An emulsion according to claim 10 wherein the dopant is located in the portion of the tabular grains containing a first precipitated 25 percent of the silver.

12. An emulsion according to claim 1 wherein the dopant is a coordination complex that (a) displaces ions in the silver halide crystal lattice of the tabular grains and exhibits a net valance more positive than the net valence of the ions it displaces, (b) contains at least one ligand that is more electronegative than any halide ion, (c) contains a metal ion having a positive valence of from +2 to +4 and having its highest energy electron occupied molecular orbital filled, and (d) has its lowest energy unoccupied molecular orbital at an energy level higher than the lowest energy conduction band of the silver halide crystal lattice forming the tabular grains.

13. An emulsion according to claim 12 wherein the metal ion is chosen from among ions of gallium, indium and a Group VIII metal.

14. An emulsion according to claim 13 wherein the dopant is a hexacoordination complex satisfying the formula:

$$[ML_6]^n$$

where

M is $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least 3 of the ligands are more electronegative than any halide ligand; and n is −2, −3 or −4.

15. An emulsion according to claim 1 wherein $R_1$ is alkyl or aryl.

16. An emulsion according to claim 1 wherein the spectral sensitizing dye exhibits a reduction potential more negative than −1.1 volts.

17. An emulsion according to claim 1 wherein the spectral sensitizing dye exhibits an oxidation potential more positive than 1.4 volts.

18. An emulsion according to claim 1 wherein the spectral sensitizing dye is a monomethine cyanine dye.

19. A photographic element comprised of a support, a first silver halide emulsion layer coated on the support and sensitized to produce a photographic record when exposed to specular light within the minus blue visible wavelength region of from 500 to 700 nm, and a second silver halide emulsion layer capable of producing a second photographic record coated over the first silver halide emulsion layer to receive specular minus blue light intended for the exposure of the first silver halide emulsion layer, the second silver halide emulsion layer being capable of acting as a transmission medium for the delivery of minus blue light intended for the exposure of the first silver halide emulsion layer in the form of specular light, wherein the second silver halide emulsion layer is comprised of an emulsion according to any one of claims 1 to 17 inclusive in which the spectral sensitizing dye exhibits peak absorption in the blue portion of the spectrum and greater than 97 percent of the total projected area of the silver halide grains having an equivalent circular diameter of at least 0.2 μm is accounted for by tabular grains having an average equivalent circular diameter of at least 0.7 μm.

20. A radiation-sensitive emulsion comprised of a dispersing medium, silver halide grains including tabular grains, said tabular grains (a) containing greater than 50 mole percent bromide, based on silver, (b) accounting for greater than 50 percent of total grain projected area, (c) exhibiting an average thickness of less than 0.07 μm, and (d) having latent image forming chemical sensitization sites on the surfaces of the tabular grains, and a spectral sensitizing dye absorbed to the surfaces of the tabular grains, wherein the tabular grains contain a dopant capable of forming shallow electron trapping sites, the surface chemical sensitization sites have been formed at least in part by reduction sensitization with a 2-[N-(2-butynyl)amino]benzoxazole, and the spectral sensitizing dye exhibits an oxidation potential more positive than 1.2 volts.

* * * * *

UNITED STATES PATENT AND TRADEMARK OFFICE

CERTIFICATE OF CORRECTION

PATENT NO. : 5,518,872
DATED : May 21, 1996
INVENTOR(S) : Roy King et al.

It is certified that errors appear in the above-identified patent and that said Letters Patent is hereby corrected as shown below:

Col. 23, line 47, after "that" insert --at--

Signed and Sealed this

Nineteenth Day of November, 1996

*Attest:*

*Attesting Officer*

BRUCE LEHMAN

*Commissioner of Patents and Trademarks*